US008247150B2

(12) United States Patent
Iwatsuki et al.

(10) Patent No.: US 8,247,150 B2
(45) Date of Patent: Aug. 21, 2012

(54) CARRIER FOR DEVELOPING ELECTROSTATIC LATENT IMAGE, TWO-COMPONENT DEVELOPER, SUPPLEMENTAL DEVELOPER, PROCESS CARTRIDGE, AND IMAGE FORMING METHOD

(75) Inventors: Hitoshi Iwatsuki, Numazu (JP); Kimitoshi Yamaguchi, Numazu (JP); Minoru Masuda, Numazu (JP); Yutaka Takahashi, Numazu (JP); Koichi Sakata, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 273 days.

(21) Appl. No.: 12/586,304

(22) Filed: Sep. 17, 2009

(65) Prior Publication Data

US 2010/0068645 A1 Mar. 18, 2010

(30) Foreign Application Priority Data

Sep. 17, 2008 (JP) ..... 2008-237481

(51) Int. Cl.
*G03G 9/113* (2006.01)

(52) U.S. Cl. ..... 430/111.35; 430/111.3; 430/122.5; 430/123.58

(58) Field of Classification Search ..... 430/111.3, 430/111.35, 122.5, 123.58
See application file for complete search history.

(56) References Cited

U.S. PATENT DOCUMENTS

| | | | | |
|---|---|---|---|---|
| 4,206,064 | A | 6/1980 | Kiuchi et al. | |
| 7,381,513 | B2 | 6/2008 | Suzuki et al. | |
| 7,468,233 | B2 | 12/2008 | Nagayama et al. | |
| 7,527,908 | B2 | 5/2009 | Iwatsuki et al. | |
| 7,553,598 | B2 | 6/2009 | Suzuki et al. | |
| 2005/0026061 | A1 * | 2/2005 | Mikuriya et al. | 430/108.1 |
| 2006/0166125 | A1 * | 7/2006 | Skorokhod et al. | 430/111.35 |
| 2006/0210905 | A1 | 9/2006 | Imahashi et al. | |
| 2007/0015078 | A1 | 1/2007 | Suzuki et al. | |
| 2007/0048652 | A1 | 3/2007 | Imahashi et al. | |
| 2007/0243482 | A1 | 10/2007 | Yamaguchi et al. | |
| 2008/0063969 | A1 | 3/2008 | Yamaguchi et al. | |
| 2008/0073252 | A1 | 3/2008 | Yamaguchi et al. | |
| 2008/0171274 | A1 * | 7/2008 | Yagi et al. | 430/48 |
| 2008/0213684 | A1 | 9/2008 | Nagayama et al. | |
| 2008/0227004 | A1 | 9/2008 | Yamaguchi et al. | |
| 2009/0041510 | A1 | 2/2009 | Imahashi et al. | |
| 2009/0074450 | A1 | 3/2009 | Nagayama et al. | |
| 2009/0092920 | A1 | 4/2009 | Nagayama et al. | |

FOREIGN PATENT DOCUMENTS

| | | |
|---|---|---|
| JP | 42-1627 | 1/1967 |
| JP | 41-20153 | 11/1967 |
| JP | 43-27596 | 11/1968 |
| JP | 44-6397 | 3/1969 |

(Continued)

OTHER PUBLICATIONS

Diamond, "Handbook of Imaging Materials," Marcel Dekker, NY, NY, 1991, p. 380-381.*

(Continued)

*Primary Examiner* — Peter Vajda
(74) *Attorney, Agent, or Firm* — Cooper & Dunham LLP

(57) ABSTRACT

A carrier for developing an electrostatic latent image which includes a core material and a resin coating layer provided on the core material. The resin coating layer includes a resin and a particulate tin oxide, and the surface of the particulate tin oxide is coated with carbon.

18 Claims, 2 Drawing Sheets

FOREIGN PATENT DOCUMENTS

| | | |
|---|---|---|
| JP | 45-26478 | 9/1970 |
| JP | 54-155048 | 12/1979 |
| JP | 55-42752 | 11/1980 |
| JP | 57-40267 | 3/1982 |
| JP | 58-108548 | 6/1983 |
| JP | 58-108549 | 6/1983 |
| JP | 59-7385 | 2/1984 |
| JP | 59-166968 | 9/1984 |
| JP | 01-19584 | 4/1989 |
| JP | 02-079862 | 3/1990 |
| JP | 03-628 | 1/1991 |
| JP | 05-273789 | 10/1993 |
| JP | 06-202381 | 7/1994 |
| JP | 06-345429 | * 12/1994 |
| JP | 07-140723 | 6/1995 |
| JP | 08-006307 | 1/1996 |
| JP | 08-179570 | 7/1996 |
| JP | 08-286429 | 11/1996 |
| JP | 09-160304 | 6/1997 |
| JP | 11-202560 | 7/1999 |
| JP | 2001-188388 | 7/2001 |
| JP | 2006-039357 | 2/2006 |

OTHER PUBLICATIONS

Translation of JP 06-345429 published Dec. 1994.*

* cited by examiner

CARRIER FOR DEVELOPING ELECTROSTATIC LATENT IMAGE, TWO-COMPONENT DEVELOPER, SUPPLEMENTAL DEVELOPER, PROCESS CARTRIDGE, AND IMAGE FORMING METHOD

BACKGROUND OF THE INVENTION

1. Field of the Invention

The present invention relates to a carrier for developing electrostatic latent images in electrophotography, electrostatic recording, and electrostatic printing. The present invention also relates to a two-component developer and a supplemental developer including the carrier, and a process cartridge including the two-component developer. The present invention further relates to an image forming method using the two-component developer.

2. Discussion of the Related Art

In typical electrophotographic image forming processes, an electrostatic latent image is formed on an image bearing member that includes a photoconductive material. Charged toner particles are adhered to the electrostatic latent image so that the electrostatic latent image is formed into a visible toner image. The toner image is transferred onto a recording medium such as paper and finally fixed thereon. Recently, the mainstream of electrophotographic copiers and printers has been rapidly switched from monochrome to full-color.

In electrophotography, a full-color image is typically produced by superimposing toners of yellow, magenta, and cyan, which are three primary colors, optionally along with black toner. In order to make a resultant image vivid and sharp, the surface of the resultant image is preferably smoothened so as to suppress light scattering. Therefore, full-color images are generally mid-gloss or high-gloss. Specifically, full-color images generally have a gloss of about 10 to 50%.

Typical methods of fixing a toner image on a recording medium include heating a fixing member (e.g., a roller or belt having a smooth surface) and pressing the fixing member against the toner image on the recording medium. This method is what is called a contact-heating fixing method. The contact-heating fixing method is capable of fixing toner images at high speed with high thermal efficiency, and advantageously producing full-color images having high gloss and transparency. The fixing member is pressed against a toner image that is melted by heat, and subsequently separated from the toner image. There is a possibility that a part of the toner image disadvantageously adheres to the fixing member and is retransferred onto another image. This phenomenon is hereinafter referred to as an offset problem.

In attempting to prevent the occurrence of the offset problem, fixing rollers having a surface made of a silicone rubber or a fluorocarbon resin have been proposed, because silicone rubbers and fluorocarbon resins generally have high separability. Also, an oil such as silicone oil is further applied to the surface of the fixing roller so as to more improve separability. This approach is effective for preventing the occurrence of the offset problem. However, this approach also has a disadvantage that fixing devices may be upsized due to provision of an oil applicator.

Another approach to prevent the occurrence of the offset problem involves improving viscoelasticity of a toner so that the toner may not internally rupture when melted. This may be achieved by controlling the molecular weight distribution of binder resins of the toner. Simultaneously, a release agent such as a wax is included in the toner and no oil or a slight amount of oil is applied to a fixing roller. This approach has been widely applied to toners for producing monochrome images (hereinafter "monochrome toners").

The same can be said for toners for producing full-color images (hereinafter "full-color toners"). Full-color toners have been also applied to fixing devices without an oil applicator recently. Full-color toners generally have lower viscoelasticity than monochrome toners in order to make the surface of a resultant image smooth. As described above, an image with a smooth surface may be vivid and sharp. However, such full-color toners are more likely to cause the offset problem because of their low viscoelasticity. Therefore, with respect to full-color toners, it may be difficult to eliminate an oil applicator or reduce the amount of oil applied to fixing rollers. Alternatively, in a case in which a release agent is included in a full-color toner, the toner may have a high adhesion force. As a result, the toner may not be reliably transferred onto paper and the release agent may exude from the toner and contaminate carriers.

With respect to carrier that triboelectrically charges toner, the following properties are generally required.

1) The surface is unlikely to be contaminated with toner.
2) The surface is formed even.
3) The surface is unlikely to be oxidized.
4) Moisture resistance is unlikely to deteriorate.
5) The lifespan is long.
6) Unlikely to adhere to image forming members such as a photoreceptor. In other words, "carrier deposition" is not caused.
7) Unlikely to scratch or abrade image forming members such as a photoreceptor.
8) The charge polarity and charge amount are controllable.

In attempting to satisfy the above requirements, one proposed approach involves providing a coating layer on a core material. The coating layer generally includes a resin having high strength. For example, Unexamined Japanese Patent Application Publication No. (hereinafter "JP-A") 58-108548 discloses a carrier in which a core material is coated with a resin layer. JP-A 54-155048, JP-A 57-40267, JP-A 58-108549, JP-A 59-166968, Examined Japanese Patent Application Publication No. (hereinafter "JP-B") 01-19584, JP-B 03-628, and JP-A 06-202381 each disclose a carrier in which a core material is coated with a resin layer including various additives. JP-A 05-273789 discloses a carrier in which an additive is adhered to the surface thereof. JP-A 09-160304 discloses a carrier having a coating layer including a conductive powder. In this carrier, the particle diameter of the conductive powder is greater than the thickness of the coating layer.

JP-A 08-6307 discloses a carrier having a coating layer including a condensate of benzoguanamine, n-butyl alcohol, and formaldehyde as a main component. Japanese Patent No. 2683624 discloses a carrier having a coating layer including a cross-linked resin of a melamine resin with an acrylic resin.

However, these carriers still have poor durability. Specifically, toners are likely to adhere to the carriers, which may result in unreliable charging of toners, and the coating layers are likely to be abraded, which may result in deterioration of resistance of the carriers. Additionally, these carriers are likely to adhere to image bearing members, which may result in gradual deterioration of image quality with time.

On the other hand, printing speeds of electrophotographic copiers and printers have been drastically enhanced recently. Disadvantageously, developers may receive greater stress in such high-speed copiers and printers. As a result, the lifespan of carriers may be shortened.

Generally, carriers include carbon black as a resistance controlling agent. When coating layer is abraded or carbon black releases from carrier, there is a possibility that carbon black contaminates resultant full-color images. This phenomenon is hereinafter referred to as a color contamination problem.

In attempting to solve the color contamination problem, JP-A 07-140723 discloses a carrier in which a conductive material (e.g., carbon black) is present on the surface of a core material but is not present in a resin coating layer. JP-A 08-179570 discloses a carrier having a resin coating layer which has a concentration gradient of carbon black in the thickness direction. The concentration of the carbon black lowers toward the surface of the resin coating layer and no carbon black exists on the surface of the resin coating layer. JP-A 08-286429 discloses a double-coated carrier in which an inner resin coating layer that includes a conductive carbon is formed on a core material, and a surface resin coating layer that includes a white conductive material is further formed on the inner resin coating layer. However, none of these carriers is resistant to high stress and solves the color contamination problem yet.

The best way to solve the color contamination problem may be to eliminate carbon black from carriers. However, if carbon black is eliminated from carriers, resistance of the carriers may disadvantageously increase because carbon black generally has a low electric resistance. A carrier having a high resistance is likely to produce an image in which the center part has an extremely low image density and the edge part has a high image density. This phenomenon is what is called an edge effect. When the image is composed of characters and thin lines, the image may be sharp due to the edge effect. However, when the image is a halftone image, the image may not be reproduced faithfully.

In attempting to solve the above-described problem caused by carbon black, resistance controlling agents other than carbon black have been proposed. For example, titanium oxide and zinc oxides have been proposed as resistance controlling agents. However, these materials are less effective than carbon black for reducing resistance of carriers.

JP-A 11-202560 discloses a carrier in which the resistance is controlled by an antimony-doped metal oxide. This carrier has a problem that the use of antimony may adversely affect human and environment. Additionally, since an antimony-doped tin oxide is bluish, there is a possibility that the color contamination problem occurs.

JP-A 2006-39357 discloses a carrier in which the resistance is controlled by a conductive filler including tin dioxide and indium oxide. However, there are problems that the resistance is controllable only within a narrow range, durability is poor, and the cost is high. In addition, indium, which is a rare metal, is difficult to use permanently. Therefore, a need exists for conductive powders which can control resistance of carriers over a wide range without causing the color contamination problem, and which are abundantly available.

SUMMARY OF THE INVENTION

Accordingly, exemplary embodiments of the present invention provide a carrier, a two-component developer, a supplemental developer, a process cartridge, and an image forming method, each of which provides high definition images with high thin-line reproducibility for an extended period of time without causing carrier deposition, edge effect, the color contamination problem, toner scattering, image density unevenness, and damage to human and environment.

These and other features and advantages of the present invention, either individually or in combinations thereof, as hereinafter will become more readily apparent can be attained by exemplary embodiments described below.

One exemplary embodiment provides a carrier for developing electrostatic latent image which includes a core material and a resin coating layer located overlying the core material. The resin coating layer includes a resin and a particulate tin oxide, and a surface of the particulate tin oxide is coated with carbon.

Another exemplary embodiment provides a two-component developer and a supplemental developer which includes a toner including a binder resin and a colorant, and the above carrier.

Yet another exemplary embodiment provides a process cartridge detachably attachable to an image forming apparatus, which includes at least one of an image bearing member, a charger, and a cleaning device, and a developing device containing the above two-component developer.

Yet another exemplary embodiment provides an image forming method which includes forming an electrostatic latent image on an image bearing member, developing the electrostatic latent image with the above two-component developer to form a toner image, transferring the toner image onto a recording medium, and fixing the toner image on the recording medium.

BRIEF DESCRIPTION OF THE DRAWINGS

A more complete appreciation of the embodiments described herein and many of the attendant advantages thereof will be readily obtained as the same becomes better understood by reference to the following detailed description when considered in connection with the accompanying drawings, wherein.

DESCRIPTION OF THE PREFERRED EMBODIMENTS

Carrier

Figure 1:
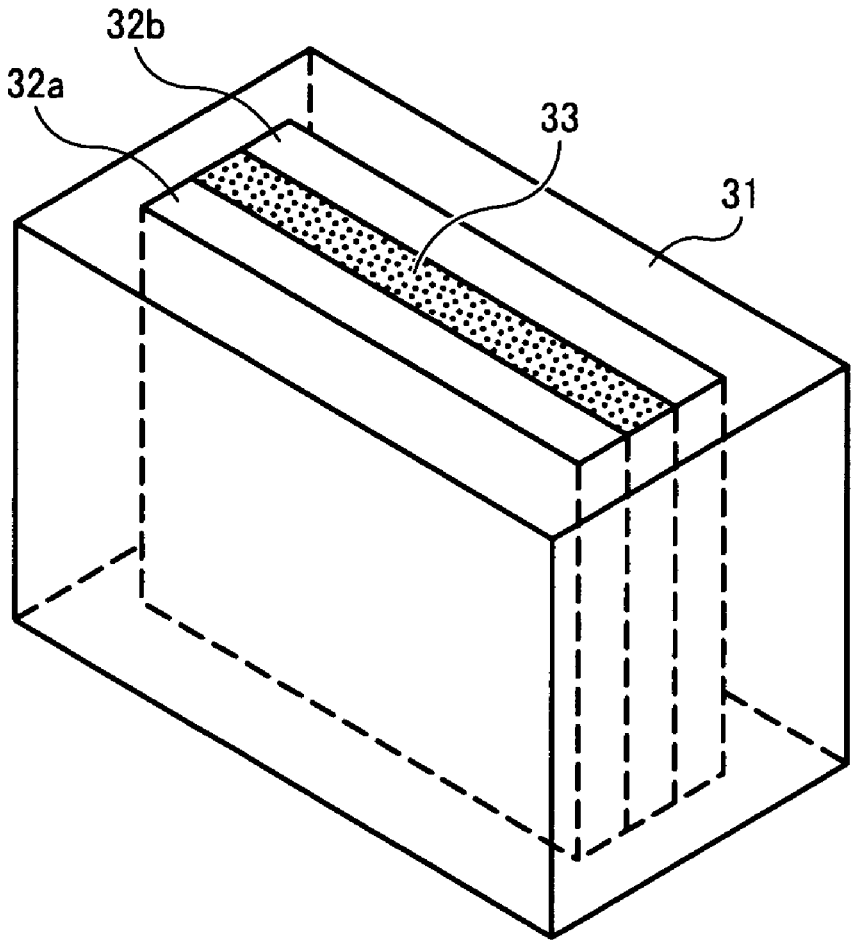
FIG. 1 is a schematic view illustrating an equipment for measuring volume resistivity of carriers.

An exemplary embodiment of the carrier of present invention includes a core material and a resin coating layer. The surface of the core material is coated with the resin coating layer. The resin coating layer includes a resin and a particulate tin oxide. The surface of the particulate tin oxide is coated with carbon.

Specific preferred materials suitable for the core material include, but are not limited to, Cu—Zn ferrite, Mn ferrite, Mn—Mg ferrite, Mn—Mg—Sr ferrite, magnetite, iron, and nickel. Specific examples of commercially available materials suitable for the core material include, but are not limited to, DFC-400M, 500M, MFL-3500HS, and SM-350NV.

As described above, the surface of the core material is coated with the resin coating layer. The resin coating layer includes a resin and a particulate tin oxide.

The resin coating layer preferably has a thickness of from 0.05 to 2.00 μm. When the thickness is too small, the resin coating layer may be abraded and the core material may be exposed. When the thickness is too large, the carrier may not charge toner sufficiently.

The thickness of the resin coating layer can be measured by observing a cross-section of the carrier using a transmission electron microscope (TEM). Specifically, the distance from a randomly-selected point on the surface of the core material to the surface of the resin coating layer is measured. This measurement is performed at 50 randomly-selected points and the measured distances are averaged.

Specific examples of usable resins for the resin coating layer include, but are not limited to, silicone resins and acrylic resins. These resins can be used alone or in combination. Silicone resins and acrylic resins are preferable, and mixtures including both a silicone resin and an acrylic resin are more preferable.

Because silicone resins generally have low surface energy, toner components are unlikely to adhere to silicone resins. Therefore, the resin coating layer including a silicone resin is unlikely to be abraded because toner components may not accumulate thereon. In the present specification, silicone resins include all silicone resins which are generally known, such as straight silicone resins consisted of organosiloxane bonds and modified silicone resins which are modified with alkyd, polyester, epoxy, acrylic, or urethane resins. Specific examples of commercially available straight silicone resins include, but are not limited to, KR271, KR255, and KR152 from Shin-Etsu Chemical Co., Ltd.; and SR2400, SR2406, and SR2410 from Dow Corning Toray Co., Ltd. These silicone resins can be used alone or in combination with other components capable of cross-linking and/or charge amount controlling agents. Specific examples of commercially available modified silicone resins include, but are not limited to, KR206 (alkyd-modified), KR5208 (acrylic-modified), ES1001N (epoxy-modified), and KR305 (urethane-modified) from Shin-Etsu Chemical Co., Ltd.; and SR2115 (epoxy-modified) and SR2110 (alkyd-modified) from Dow Corning Toray Co., Ltd.

Because of having high adhesiveness and low brittleness, acrylic resins generally have excellent abrasion resistance. Therefore, the resin coating layer including an acrylic resin is unlikely to be abraded or peel off. In addition, the resin coating layer including an acrylic resin reliably retains particulate materials, especially those having a particle diameter greater than the thickness of the resin coating layer, such as particulate tin oxide, due to high adhesiveness of the acrylic resin.

In the present specification, acrylic resins include all acrylic resins which are generally known. Acrylic resins can be used alone or in combination with other components capable of cross-linking. The components capable of cross-linking may be amino resins or acid catalysts, for example. Specific examples of usable amino resins include, but are not limited to, guanamine and melamine. Specific examples of usable acid catalysts include, but are not limited to, all compounds that have catalysis such as compounds having a reactive group such as completely-alkylated-type, methylol-type, imino-type, and methylol-imino type group.

As described above, acrylic resins advantageously have excellent abrasion resistance because of having high adhesiveness and low brittleness. At the same time, disadvantageously, toner components are likely to adhere to acrylic resins because acrylic resins have high surface energy. Therefore, toner components are likely to accumulate on the resin coating layer including an acrylic resin, resulting in deterioration of charging ability.

By contrast, advantageously, toner components are unlikely to adhere to silicone resins because silicone resins have low surface energy. Therefore, the resin coating layer including a silicone is unlikely to be abraded because toner components may not accumulate thereon. At the same time, silicone resins disadvantageously have poor abrasion resistance because of having low adhesiveness and high brittleness.

Accordingly, the resin coating layer preferably includes both a silicone resin and an acrylic resin so as to compensate their disadvantages with each other while achieving a good balance between the silicone resin and the acrylic resin.

The resin coating layer includes a particulate tin oxide which is coated with carbon.

In particular, an outermost surface of the particulate tin oxide is coated with a compound including carbon.

In a case in which the amount of carbon present on the surface of the particulate tin oxide is too large, the resistance of the particulate tin oxide may have poor temporal stability. Additionally, in a case in which the resin coating layer is abraded, the color contamination problem may occur. In view of these facts, the amount of carbon present on the surface of the particulate tin oxide is preferably as small as possible.

The particulate tin oxide preferably has a primary particle diameter of from 1 to 500 nm, more preferably from 1 to 200 nm, and much more preferably from 1 to 50 nm. When the primary particle diameter is less than 1 nm, it may be difficult to control dispersion state of the particulate tin oxide in the resin coating layer. When the primary particle diameter is larger than 500 nm, the particulate tin oxide is so large that adhesion between the particulate tin oxide and the resin may deteriorate. As a result, the particulate tin oxide may release from the resin coating layer or the resin coating layer may peel off.

When the primary particle diameter is 200 nm or less, large-size fillers having a particle diameter of about 200 nm which are generally used for toners are unlikely to adhere to the carriers. Accordingly, temporal stability of chargeability and fluidity may improve. When the primary particle diameter is 50 nm or less, either inter-carrier-particle or intra-carrier-particle evenness of the particulate tin oxide in the resin coating layer may improve. As a result, the carrier may have reliable properties.

Generally, the smaller the particle diameter of a particle, the greater the cohesion force of the particle. Therefore, it may be difficult to disperse the particulate tin oxide into primary particles. When aggregations of the particulate tin oxide are present in a coating liquid for forming the resin coating layer, the coating liquid may be uneven and may cause clogging in coating equipment.

When such a coating liquid is applied to carriers, the particulate tin oxide may unevenly adhere to the resultant resin coating layer. Therefore, intraparticle evenness of surface resistance and chargeability may be poor. At the same time, interparticle evenness of surface resistance and chargeability may be also poor.

The intraparticle and interparticle unevenness of the carrier means that a part of a carrier particle or some carrier particles has or have a low resistance, which is disadvantageous. For example, carrier particles may adhere to solid images during high-speed printing.

As another example, the intraparticle and interparticle unevenness of the carrier may cause toner scattering because the carrier cannot sufficiently charge toner especially when the carrier is covered with the toner at high coverage.

Accordingly, the particulate tin oxide is preferably dispersed in the coating liquid using a media disperser rather than using shearing forces generated from a gap. Suitable media dispersers are preferably filled with small-size media having a particle diameter of 1 mm or less rather than beads having a particle diameter of several mm.

The primary particle diameter of a particulate material can be measured as follows. First, 30 ml of an aminosilane (SH6020 from Dow Corning Toray Co., Ltd.) and 300 ml of toluene are contained in a juicer-mixer, and subsequently 6.0 g of a sample (a particulate material) are further added thereto. The mixture is subjected to a dispersion treatment for 3 minutes with setting the revolution of the mixer to "low". The resultant dispersion is added to 500 ml of toluene contained in a 1000-ml beaker. The resultant diluted dispersion is subjected to a measurement of the primary particle diameter using a particle size distribution analyzer CAPA-700 (from Horiba, Ltd.) while being agitated by a homogenizer.

The measurement conditions are as follows.

Revolution: 2,000 rpm

Maximum particle size: 2.0 μm

Minimum particle size: 0.1 μm

Particle size interval: 0.1 μm

Viscosity of dispersion medium: 0.59 mPa·s

Density of dispersion medium: 0.87 g/cm$^3$

Density of particulate material: input absolute specific gravity measured by a gas pycnometer ACCUPYC 1330 (from Micromeritics Instrument Corporation)

It is preferable that antimony is not detected from the particulate tin oxide by a thermal analysis.

It is also preferable that indium is not detected from the particulate tin oxide by a thermal analysis.

Conventionally, particulate tin oxides are included in resin coating layers as fillers, and the volume resistivity thereof is controlled by coating the particulate tin oxides with antimony and/or indium.

A particulate tin oxide which includes antimony is bluish. Therefore, when a particulate tin oxide which includes antimony is included in a resin coating layer of a carrier and the resin coating layer is abraded, there is a possibility that the color contamination problem occurs. Besides, antimony is harmful to human and environment. Accordingly, antimony is not preferably included in carriers.

Since indium is a rare metal, it is difficult to use indium permanently. In addition, there are other problems that the resistance is controllable only within a narrow range and the cost is high.

An exemplary method of producing a particulate tin oxide is described below.

It is not preferable to disperse particles of a tin oxide using a large shearing force, because the particles may aggregate or gelate. Even if the shearing force is reduced, particles may not be dispersed finely. Accordingly, it is preferable to disperse particles of a tin oxide using a media disperser, which is a milder dispersion means than shearing forces generated from a gap.

The carrier preferably has a volume resistivity of from $1\times10^9$ to $1\times10^{17}$ Ω·cm. When the volume resistivity is too small, it may be difficult to prevent charge leakage. When the volume resistivity is too large, an image in which the center part has an extremely low image density and the edge part has a high image density may be produced, in other words, the edge effect may occur.

The volume resistivity of carriers can be measured as follows. FIG. 1 is a schematic view illustrating an equipment for measuring volume resistivity of carriers.

A cell 31 is a container made of a fluorocarbon resin and contains electrodes 32*a* and 32*b*. The electrodes 32*a* and 32*b* each have a surface area of 2.5 cm×4 cm and the distance between the electrodes 32*a* and 32*b* is 0.2 cm. The cell 31 is charged with a carrier (i.e., an initial carrier) 33, and tapped from a height of 1 cm for 10 times at a speed of 30 times/min. Thirty seconds after a direct current voltage of 1,000 V is applied between the electrodes, a resistance value (r) is measured using a HIGH RESISTANCE METER 4329A (from Hewlett-Packard Japan, Ltd.). The volume resistivity (R) is calculated from the following equation:

$$R=\text{Log}\,[r\times(2.5\ (\text{cm})\times4\ (\text{cm}))/0.2\ (\text{cm})](\text{Log}(\Omega\cdot\text{cm}))$$

From the viewpoint of image quality, the carrier is preferably controlled to have an appropriate volume resistivity. One proposed approach to control volume resistivity involves including fillers in the resin coating layer. When the volume resistivity of a filler is too high, leakage speed of charge from the carrier may be very slow. Therefore, counter charge that is generated after development of toner image may leak so slowly that new toner particles may not be charged, resulting in the occurrence of toner scattering in non-image areas. Alternatively, counter charge that is generated after development of toner image may further generate mirror force on a developing sleeve. In this case, a developer which should have been released from the developing sleeve is conveyed by the developing sleeve. Because the developer which has been conveyed by the developing sleeve may include toner particles in a smaller amount compared to a fresh developer, a mixture of such a developer and the fresh developer may produce images with uneven image density.

The particulate tin oxide used for the present invention has a low volume resistivity because of being coated with carbon. Therefore, contaminants adhered to the resin coating layer may easily release therefrom. The particulate tin oxide which is covered with carbon is capable of not only controlling volume resistivity of carrier but also leaking charge quickly. Therefore, fresh toner particles are sufficiently charged, thereby preventing the occurrence of toner scattering. Additionally, the use of the particulate tin oxide which is covered with carbon provides images with even image density because the developer may not be conveyed by a developing sleeve.

In the carrier of the present invention, the standard deviation (σ) of the cover area ratio of tin is preferably 20 or less, more preferably 10 or less, and much more preferably 5 or less. When the standard deviation (σ) of the cover area ratio of tin is too large, it means that tin covers carrier particles unevenly. In other words, it means that the amount of carrier particles without desired volume resistance is large, which results in poor productivity of carrier.

The standard deviation (σ) of the cover area ratio of tin can be measured by EDX mapping of Sn under the following conditions. A ratio of a covering area of Sn to a surface area of one particle of a carrier is determined by image analysis. More than 10 carrier particles are subjected to this measurement procedure.

Method of fixation of specimen: Carbon tape (8 mm×20 m, from Nisshin EM Corporation)

Vapor deposition: No

Accelerating voltage: 10 kV

WD: 13 mm

Aperture diameter: 30 μm

Drift correlation: No

Use of High current: No

Time constant: 20 to 30

Magnification of EDX measurement: 1000 times, 3000 times

Cumulated number: 100

Mapping (count/quantitative determination/simplified quantitative determination): count mapping Characteristic X-ray used for mapping (L-line/K-line): L-line The carrier of the present invention preferably has a volume average particle diameter of from 20 to 65 μm. When the volume average particle diameter is too small, the carrier may adhere to image bearing members. When the volume average particle diameter is too large, high definition images may not be produced.

The carrier of the present invention preferably has a magnetization of from 40 to 90 $Am^2/kg$ in a magnetic field of 1,000 ($10^3/4\pi \cdot A/m$) (i.e., 1 kOe). In this case, retention force between carrier particles may be appropriate and a toner may be quickly mixed with the carrier. When the magnetization in a magnetic field of 1 kOe is too small, the carrier may adhere to image bearing members. When the magnetization in a magnetic field of 1 kOe is too large, the carrier particles may form inflexible brushes on a developing sleeve, which may not produce high definition images.

The carrier of the present invention may further include other materials. For example, the resin coating layer may include a particulate nonconductive material for the purpose of easily controlling the surface shape of the carrier and properties of the resin coating layer. By achieving a good balance between a particulate conductive material (i.e., the particulate tin oxide) and a particulate nonconductive material, it is possible to simultaneously control the strength of the resin coating layer, the surface shape of the carrier, and the volume resistivity of the carrier.

(Two-Component Developer)

An exemplary embodiment of the two-component developer of the present invention includes a toner including a binder resin and a colorant, and the carrier described above.

Because the carrier provides high definition images and has a long lifespan, the carrier is preferably combined with a toner including a release agent.

Additionally, the carrier is preferably combined with a toner other than black toner (hereinafter "color toner"). This is because the resin coating layer of the carrier does not include carbon black and therefore the color contamination problem is unlikely to occur. Suitable color toners include, but are not limited to, yellow, magenta, cyan, red, green, and blue toners which are usable for both single-color and full-color images.

(Toner)

An exemplary toner includes a binder resin and a colorant. In the present specification, toners include all toners which are generally known such as black toners, color toners, pulverization toners, and polymerization toners. In particular, the toner preferably includes a mother toner that includes a binder resin and a colorant, and an external additive that is adhered to the surface of the mother toner. Toners including a release agent (hereinafter "oil-less toner") may be also preferable. It is generally known that release agents in oil-less toners easily adhere to conventional carriers, however, the carrier of the present invention is resistant to such adhesion of release agents. It is also generally known that oil-less full-color toners easily adhere to conventional carriers because the binder resin is soft, however, the carrier of the present invention is resistant to such adhesion of soft binder resins.

With respect to yellow toners, the color contamination problem may notably occur when the resin coating layer is abraded. However, the carrier of the present invention is unlikely to cause such color contamination problem even with yellow toners.

Specific examples of usable binder resin for toners include, but are not limited to, homopolymers of styrene or styrene derivatives (e.g., polystyrene, poly-p-styrene, polyvinyl toluene), styrene copolymers (e.g., styrene-p-chlorostyrene copolymer, styrene-propylene copolymer, styrene-vinyl toluene copolymer, styrene-methyl acrylate copolymer, styrene-ethyl acrylate copolymer, styrene-methacrylic acid copolymer, styrene-methyl methacrylate copolymer, styrene-ethyl methacrylate copolymer, styrene-butyl methacrylate copolymer, styrene-methyl α-chloromethacrylate copolymer, styrene-acrylonitrile copolymer, styrene-vinyl methyl ether copolymer, styrene-vinyl methyl ketone copolymer, styrene-butadiene copolymer, styrene-isopropyl copolymer, styrene-maleate copolymer), polymethylmethacrylate, polybutyl methacrylate, polyvinyl chloride, polyvinyl acetate, polyethylene, polyester, polyurethane, epoxy resins, polyvinyl butyral, polyacrylic acid resins, rosin, modified rosin, terpene resins, phenol resins, aliphatic or aromatic hydrocarbon resins, and aromatic petroleum resins. These resins can be used alone or in combination.

Additionally, binder resins which are generally used for pressure fixing may be also preferable. Specific examples of binder resins for pressure fixing include, but are not limited to, polyolefins (e.g., low-molecular-weight polyethylene, low-molecular-weight polypropylene), olefin copolymers (e.g., ethylene-acrylic resin copolymer, ethylene-acrylate copolymer, styrene-methacrylic acid copolymer, ethylene-methacrylate copolymer, ethylene-vinyl chloride copolymer, ethylene-vinyl acetate copolymer, ionomer resins), epoxy resins, polyester resins, styrene-butadiene copolymers, polyvinyl pyrrolidone, methyl vinyl ether-maleic anhydride, maleic acid-modified phenol resins, and phenol-modified terpene resins. These resins can be used alone or in combination.

All pigments and dyes which are generally known can be used as the colorant.

Specific examples of usable yellow colorants include, but are not limited to, Cadmium Yellow, Mineral Fast Yellow, Nickel Titan Yellow, Naples Yellow, NAPHTHOL YELLOW S, HANSA YELLOW G, HANSA YELLOW 10G, BENZIDINE YELLOW GR, Quinoline Yellow Lake, PERMANENT YELLOW NCG, and Tartrazine Lake.

Specific examples of usable orange colorants include, but are not limited to, molybdenum orange, PERMANENT ORANGE GTR, pyrazolone orange, vulcan orange, INDANTHRENE BRILLIANT ORANGE RK, Benzidine Orange G, and INDANTHRENE BRILLIANT ORANGE GK.

Specific examples of usable red colorants include, but are not limited to, red iron oxide, cadmium red, PERMANENT RED 4R, Lithol Red, Pyrazolone Red, watching red calcium salt, Lake Red D, Brilliant Carmine 6B, Eosin Lake, Rhodamine Lake B, Alizarine Lake, and Brilliant Carmine 3B.

Specific examples of usable violet colorants include, but are not limited to, Fast Violet B and Methyl Violet Lake.

Specific examples of usable blue colorants include, but are not limited to, cobalt blue, Alkali Blue, Victoria Blue Lake, Phthalocyanine Blue, metal-free Phthalocyanine Blue, partially-chlorinated Phthalocyanine Blue, Fast Sky Blue, and INDANTHRENE BLUE BC.

Specific examples of usable green colorants include, but are not limited to, Chrome Green, chromium oxide, Pigment Green B, and Malachite Green Lake.

Specific examples of usable black colorants include, but are not limited to, azine dyes (e.g., carbon black, oil furnace black, channel black, lampblack, acetylene black, aniline black), metal salt azo dyes, metal oxides, and combined metal oxides.

These colorants can be used alone or in a combination.

The toner may include a charge controlling agent, if desired. Specific examples of usable charge controlling agents include, but are not limited to, Nigrosine dyes, azine dyes having an alkyl group having 2 to 16 carbon atoms (disclosed in JP-B 42-1627, the disclosure thereof being incorporated herein by reference), basic dyes (e.g., C. I. Basic Yellow 2 (C. I. 41000), C. I. Basic Yellow 3, C. I. Basic Red 1 (C. I. 45160), C. I. Basic Red 9 (C. I. 42500), C. I. Basic Violet 1 (C. I. 42535), C. I. Basic Violet 3 (C. I. 42555), C. I. Basic Violet 10 (C. I. 45170), C. I. Basic Violet 14 (C. I. 42510), C. I. Basic Blue 1 (C. I. 42025), C. I. Basic Blue 3 (C. I. 51005), C. I. Basic Blue 5 (C. I. 42140), C. I. Basic Blue 7 (C. I. 42595), C. I. Basic Blue 9 (C. I. 52015), C. I. Basic Blue 24 (C. I. 52030), C. I. Basic Blue 25 (C. I. 52025), C. I. Basic Blue 26 (C. I. 44045), C. I. Basic Green 1 (C. I. 42040), C. I. Basic Green 1 (C. I. 42000)), lake pigments of the above basic dyes, C. I. Solvent Black 8 (C. I. 26150), quaternary ammonium salts (e.g., benzoyl methyl hexadecyl ammonium chloride, decyl trimethyl chloride), dialkyl (such as dibutyl and dioctyl) tin compounds, dialkyl tin borate compounds, guanidine derivatives, polyamine resins (e.g., vinyl polymers having an amino group, condensed polymers having an amino group), metal complex of monoazo dyes (disclosed in JP-B 41-20153, JP-B 43-27596, JP-B 44-6397, and JP-B45-26478, the disclosures thereof being incorporated herein by reference), metal complexes of salicylic acid, dialkyl salicylic acid, naphthoic acid, and dicarboxylic acid with metals such as Zn, Al, Co, Cr, and Fe (disclosed in JP-B 55-42752 and JP-B 59-7385, the disclosures thereof being incorporated herein by reference), sulfonated copper phthalocyanine pigments, organic borate salts, fluorine-containing quaternary ammonium salts, and calixarene compounds. Color toners other than black toners preferably include a metal salt of a salicylic acid derivative that is whitish.

The two-component developer of the present invention includes the carrier described above and a toner which includes a mother toner including a binder resin and a colorant and an external additive, preferably a silica, that is adhered to the surface of the mother toner. When the external additive added to the toner is a silica, the two-component developer has good charge stability and a long lifespan.

Specific examples of usable external additives other than silica include, but are not limited to, particulate inorganic materials such as titanium oxide, alumina, silicon carbide, silicon nitride, and boron nitride, and particulate resins. The external additive is adhered to the surface of a mother toner so as to improve transferability and durability of the resultant toner. These improvements may be achieved because the external additive covers a wax which is present on the surface of the mother toner, and because the area of contact of the mother toner is reduced because the surface of the mother toner is covered with fine particles. The surface of the particulate inorganic material is preferably hydrophobized. For example, fine particles of hydrophobized metal oxides such as silica and titanium oxide are preferable as the external additive.

Specific preferred examples of usable particulate resins include, but are not limited to, fine particles of polymethyl methacrylate and polystyrene which are obtained by soap-free emulsion polymerization and which have an average particle diameter of from 0.05 to 1 μm. When a hydrophobized silica and a hydrophobized titanium oxide are used in combination and the amount of the hydrophobized silica is greater than that of the hydrophobized titanium oxide, chargeability of the resultant toner is resistant to humid conditions.

Specific examples of usable hydrophobizing agents include, but are not limited to, dimethyldichlorosilane, trimethylchlorosilane, methyltrichlorosilane, allyldimethyldichlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, chloromethyltrichlorosilane, p-chlorophenyltrichlorosilane, 3-chloropropyltrichlorosilane, 3-chloropropyltrimethoxysilane, vinyltriethoxysilane, vinyltrimethoxysilane, vinyl-tris(β-methoxyethoxy) silane, γ-methacryloxypropyltrimethoxysilane, vinyltriacetoxysilane, divinyldichlorosilane, dimethylvinylchlorosilane, octyl-trichlorosilane, decyl-trichlorosilane, nonyl-trichlorosilane, (4-t-propylphenyl)-trichlorosilane, (4-t-butylphenyl)trichlorosilane, dibenzyl-dichlorosilane, dihexyl-dichlorosilane, dioctyl-dichlorosilane, dinonyl-dichlorosilane, didecyl-dichlorosilane, didodecyl-dichlorosilane, dihexadecyl-dichlorosilane, (4-t-butylphenyl)-octyl-dichlorosilane, dioctyl-dichlorosilane, didecenyl-dichlorosilane, dinonenyl-dichlorosilane, di-2-ethylhexyl-dichlorosilane, di-3,3-dimethylbenzyl-dichlorosilane, trihexyl-chlorosilane, trioctyl-chlorosilane, tridecyl-chlorosilane, dioctyl-methyl-chlorosilane, octyl-dimethyl-chlorosilane, (4-t-propylphenyl)-diethyl-chlorosilane, octyltrimethoxysilane, hexamethyldisilazane, hexaethyldisilazane, diethyltetramethyldisilazane, hexaphenyldisilazane, and hexatolyldisilazane. Additionally, titanate coupling agents and aluminum coupling agents may also be usable.

Further, for the purpose of improving cleanability, fine particles of lubricants such as metal salts of fatty acids and polyvinylidene fluoride may be usable as the external additive.

The toner may optionally include a fixing auxiliary agent so that the toner is applicable to oil-less fixing systems in which no oil is applied to a fixing roller. Specific examples of usable fixing auxiliary agents include, but are not limited to, olefins such as polyethylene and polypropylene, metal salts of fatty acids, fatty acid esters, paraffin waxes, amide waxes, polyvalent alcohol waxes, silicone varnishes, carnauba waxes, and ester waxes.

An exemplary toner may be produced by a typical toner production method such as a pulverization method and a polymerization method. In pulverization methods, toner components are kneaded by a kneader. The kneader may be a batch kneader such as a double roll and a BUNBURY mixer, or a continuous kneader. Specific examples of commercially available kneaders include, but are not limited to, twin-screw extruders such as TWIN SCREW EXTRUDER KTK from Kobe Steel, Ltd., TWIN SCREW COMPOUNDER TEM from Toshiba Machine Co., Ltd., MIRACLE K. C.K from Asada Iron Works Co., Ltd., TWIN SCREW EXTRUDER PCM from Ikegai Co., Ltd., and KEX EXTRUDER from Kurimoto, Ltd.; and single-screw extruders such as KOKNEADER from Buss Corporation. Toner components are kneaded by a kneader. The kneaded mixture is cooled, and subsequently coarsely pulverized using a hammer mill or ROATPLEX and finely pulverized using a pulverizer using jet stream or a mechanical pulverizer.

The kneaded mixture is preferably pulverized into particles having an average particle diameter of from 3 to 15 μm. The pulverized particles are preferably classified using a wind power classifier so that particles having a particle diameter of from 5 to 20 μm are collected. The collected particles comprise a mother toner. The mother toner is mixed with an external additive using a mixer so that coarse particles of the external additives cover the surface of the mother toner while being ground into fine particles. The external additive, such as particulate inorganic material and particulate resins, are preferably adhered to the mother toner as evenly and strongly as possible from the viewpoint of durability.

(Supplemental Developer)

The carrier of the present invention can be used for a supplemental developer including a carrier and a toner. Supplemental developers are generally supplied to image forming apparatuses which produce images while discharging excessive developers from developing devices. Such image forming apparatuses reliably produce high quality images for an extended period of time. Specifically, deteriorated carrier particles in a developing device are replaced with fresh carrier particles in a supplemental developer so that toner particles are reliably charged for an extended period of time. Such image forming apparatuses are effective to solve a problem in printing images with high image area ratio. The problem is that carrier particles are deteriorated mainly by adhesion of toner particles when images with high image area ratio are produced. In the above-described image forming apparatuses, the amount of supplied carrier particles may be large when images with high image area ratio are produced, and therefore deteriorated carrier particles may be replaced more frequently. As a result, reliable images are produced for an extended period of time.

An exemplary supplemental developer preferably includes a carrier in an amount of 1 part by weight and a toner in an amount of from 2 to 50 parts by weight. When the amount of a toner in a supplemental developer is too small, the amount of carrier particles supplied to a developing device may be so large that toner particles may be excessively charged. When toner particles are excessively charged, developing ability of the toner particles may deteriorate and the resulting image density may be low. In addition, carrier deposition may occur. When the amount of a toner in a supplemental developer is too large, too small an amount of deteriorated carrier particles are replaced with fresh carrier particles to prevent deterioration of image quality.

(Process Cartridge)

An exemplary embodiment of the process cartridge of the present invention includes a developing device containing the two-component developer described above and at least one of an image bearing member, a charger, and a cleaning device.

Figure 2:
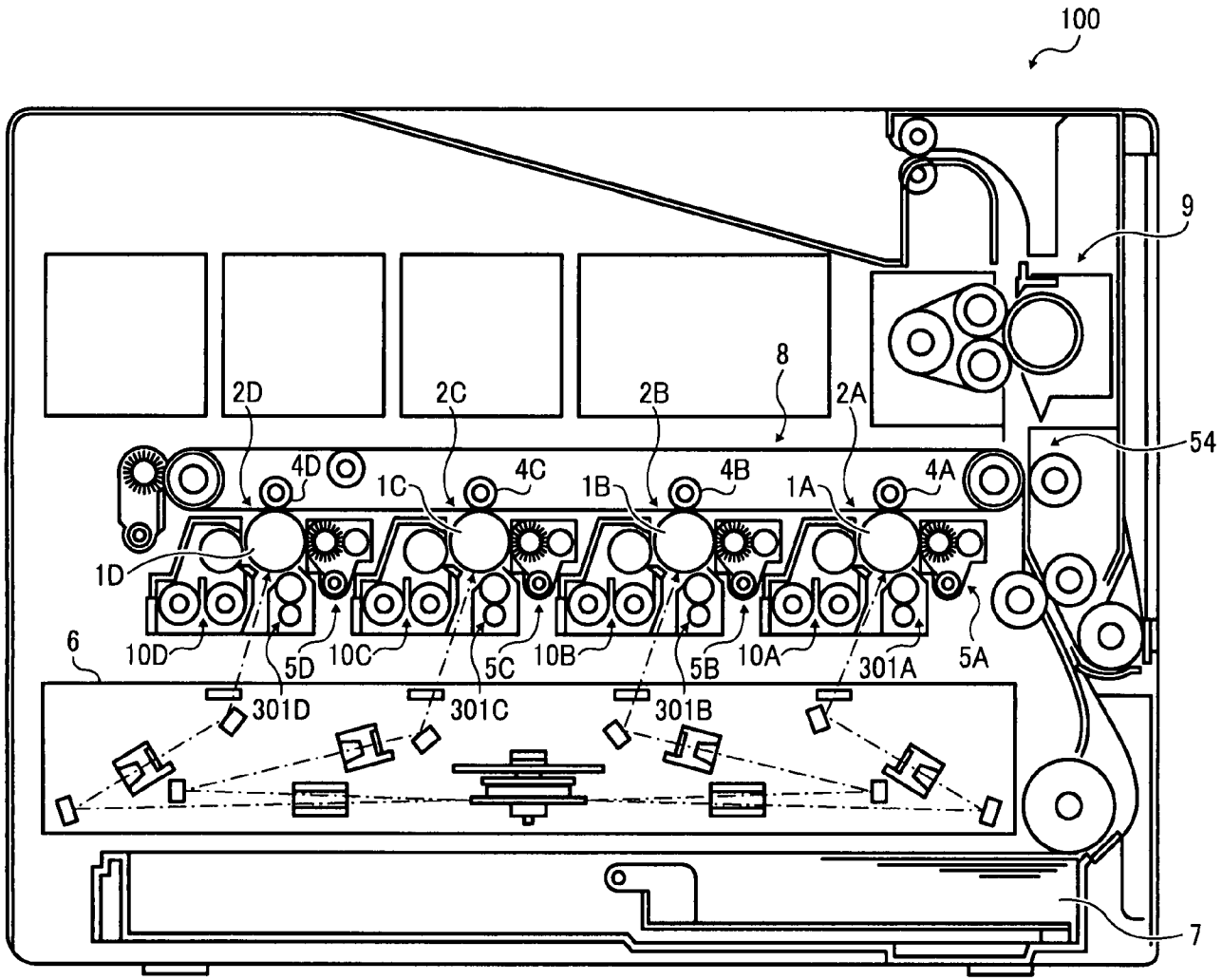
FIG. 2 is a schematic view illustrating an embodiment of an image forming apparatus including a process cartridge.

As illustrated in FIG. 2, such a process cartridge may be provided to an image forming apparatus.

An image forming apparatus 100 illustrated in FIG. 2 includes four process cartridges 2A, 2B, 2C, and 2D. The process cartridges 2A, 2B, 2C, and 2D each include image bearing members 1A, 1B, 1C, and 1D, chargers 301A, 301B, 301C, and 301D, developing devices 10A, 10B, 10C, and 10D, and cleaning devices 5A, 5B, 5C, and 5D, respectively. Since the process cartridges 2A, 2B, 2C, and 2D have the same configuration and operation, the additional characters A, B, C, and D representing toner colors are hereinafter omitted.

The image bearing member 1 is driven to rotate at a predetermined circumferential speed. A circumferential surface of the image bearing member 1 is evenly charged to a predetermined positive or negative potential by the charger 301 and exposed to a light beam emitted from an irradiator 6 (such as a slit irradiator or a laser beam scanning irradiator) while rotating, so that an electrostatic latent image is formed thereon. The electrostatic latent image is developed with a toner by the developing device 10 to form a toner image. The toner image is transferred onto an intermediate transfer member 8 by a primary transfer device 4. Subsequently, the toner image is transferred onto a transfer medium 7 by a secondary transfer device 54. The transfer medium 7 is fed from a paper feed part to between the intermediate transfer member 8 and the secondary transfer device 54 in synchronization with an entry of the toner image thereto. The transfer medium 7 having the toner image thereon is separated from the surface of the intermediate transfer member 8 and introduced into a fixing device 9. The toner image is fixed on the transfer medium 7 and discharged from the image forming apparatus 100. Residual toner particles remaining on the surface of the image bearing member 1 without being transferred are removed by the cleaning device 5 to clean the surface of the image bearing member 1. The surface of the image bearing member 1 is further neutralized for preparing for a net image operation.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Particulate Tin Oxide 1

A powder of tin oxide having a BET specific surface area of 5 $m^2/g$ is subjected to a surface treatment by being dipped in ethanol and heated to 250° C. for 1 hour under nitrogen atmosphere. Thus, a particulate tin oxide 1 is prepared.

Preparation of Particulate Tin Oxide 2

A powder of tin oxide having a BET specific surface area of 15 $m^2/g$ is subjected to a surface treatment by being dipped in ethanol and heated to 250° C. for 1 hour under nitrogen atmosphere. Thus, a particulate tin oxide 2 is prepared.

Preparation of Particulate Tin Oxide 3

A powder of tin oxide having a BET specific surface area of 50 $m^2/g$ is subjected to a surface treatment by being heated to 300° C. for 2 hours while contacting acetone gas under nitrogen atmosphere. Thus, a particulate tin oxide 3 is prepared.

Preparation of Particulate Tin Oxide 4

The powder of tin oxide having a BET specific surface area of 50 $m^2/g$ which is not subjected to any surface treatment is defined as a particulate tin oxide 4.

Preparation of Particulate Tin Oxide 5

The powder of tin oxide having a BET specific surface area of 50 $m^2/g$ is treated with ATO (antimony trioxide) so that an ATO-coated powder of tin oxide is prepared. Thus, a particulate tin oxide 5 is prepared.

The BET specific surface area is measured using a rapid surface area measuring device SA-1100 from Sibata Scientific Technology Ltd.

The amount of carbon in the particulate tin oxides 1 to 5 is quantitatively determined by a high-frequency combustion-infrared absorption spectrometry using an instrument IR-412 from LECO Japan Corporation.

Example 1

Preparation of Carrier 1

To prepare a resin coating layer forming liquid, 138.95 parts of an acrylic resin solution (including solid components in an amount of 50% by weight), 43.4 parts of a guanamine solution (including solid components in an amount of 70% by weight), 0.77 parts of an acid catalyst (including solid components in an amount of 40% by weight), 650.3 parts of a silicone resin solution (SR2410 from Dow Corning Toray Co., Ltd., including solid components in an amount of 20% by weight), 0.8 parts of an aminosilane (SH6020 from Dow Corning Toray Co., Ltd., including solid components in an amount of 100% by weight), 231.7 parts of the particulate tin oxide 1, and 2,800 parts of toluene are dispersed for 10 minutes using a HOMOMIXER.

The resulting resin coating layer forming liquid is applied to the surface of a core material using a SPIRA COTA® (from Okada Seiko Co., Ltd.) at an inner temperature of 40° C., followed by drying. The core material is a calcined ferrite powder having a volume average particle diameter of 35 μm. The resultant resin coating layer has a thickness of 1.0 μm. The core material having the resin coating layer is calcined in an electric furnace for 1 hour at 300° C., followed by cooling. The bulk of the calcined core material is sieved with a mesh having openings of 63 μm. Thus, a carrier 1 having a volume resistivity of 11.0 Log(Ω·cm) and a magnetization of 68 $Am^2/kg$ (in a magnetic field of 1 kOe) is prepared.

(Preparation of Toner 1)

Toner components including 100 parts of a binder resin (a polyester resin having a number average molecular weight (Mn) of 3,800, a weight average molecular weight (Mw) of 20,000, a glass transition temperature (Tg) of 60° C., and a softening point of 122° C.), 5 parts of a colorant (an azo yellow pigment C. I. P. Y. 180), 2 parts of a charge controlling agent (zinc salicylate), and 3 parts of a release agent (a carnauba wax having a melting point of 82° C.) are mixed using a HENSCHEL MIXER. The mixture is melted and kneaded using a double roll mill for 40 minutes at 120° C., followed by cooling. The kneaded mixture is coarsely pulverized using a hammer mill and then finely pulverized using an air jet pulverizer. The resultant particles are classified by size so that a mother toner having a weight average particle diameter of 5 μm is obtained. Further, 100 parts of the mother toner is mixed with 1 part of a hydrophobized silica and 1 part of a titanium oxide which is prepared by a wet method using a HENSCHEL MIXER. Thus, a toner 1, which is yellow, is prepared.

(Preparation of Developer 1)

To prepare a developer 1, 7 parts of the toner 1 and 93 parts of the carrier 1 are mixed. The developer 1 includes the toner in an amount of 7% by weight.

Example 2

The procedure in Example 1 is repeated except that the resin coating layer forming liquid is subjected to a dispersion treatment for 10 minutes using a vibration disperser or a bead mill filled with Zr media in place of HOMOMIXER. Thus, a carrier 2 and a developer 2 are prepared.

Example 3

The procedure in Example 2 is repeated except that the dispersion time is charged to 1 hour. Thus, a carrier 3 and a developer 3 are prepared.

Example 4

The procedure in Example 1 is repeated except for replacing the particulate tin oxide 1 with the particulate tin oxide 2. Thus, a carrier 4 and a developer 4 are prepared.

Example 5

The procedure in Example 4 is repeated except that the resin coating layer forming liquid is subjected to a dispersion treatment for 10 minutes using a vibration disperser or a bead mill filled with Zr media in place of HOMOMIXER. Thus, a carrier 5 and a developer 5 are prepared.

Example 6

The procedure in Example 5 is repeated except that the dispersion time is charged to 1 hour. Thus, a carrier 6 and a developer 6 are prepared.

Example 7

The procedure in Example 1 is repeated except for replacing the particulate tin oxide 1 with the particulate tin oxide 3. Thus, a carrier 7 and a developer 7 are prepared.

Example 8

The procedure in Example 7 is repeated except that the resin coating layer forming liquid is subjected to a dispersion treatment for 10 minutes using a vibration disperser or a bead mill filled with Zr media in place of HOMOMIXER. Thus, a carrier 8 and a developer 8 are prepared.

Example 9

The procedure in Example 7 is repeated except that the dispersion time is charged to 1 hour. Thus, a carrier 9 and a developer 9 are prepared.

Example 10

The procedure in Example 9 is repeated except that the resin coating layer forming liquid is changed to another resin coating layer forming liquid including 69.475 parts of an acrylic resin solution (including solid components in an amount of 50% by weight), 21.7 parts of a guanamine solution (including solid components in an amount of 70% by weight), 0.39 parts of an acid catalyst (including solid components in an amount of 40% by weight), 325.15 parts of a silicone resin solution (SR2410 from Dow Corning Toray Co., Ltd., including solid components in an amount of 20% by weight), 0.4 parts of an aminosilane (SH6020 from Dow Corning Toray Co., Ltd., including solid components in an amount of 100% by weight), 115.9 parts of the particulate tin oxide 3, and 1,400 parts of toluene. Thus, a carrier 10 and a developer 10 are prepared.

Example 11

The procedure in Example 9 is repeated except that the resin coating layer forming liquid is changed to another resin coating layer forming liquid including 13.2 parts of an acrylic resin solution (including solid components in an amount of 50% by weight), 4.1 parts of a guanamine solution (including solid components in an amount of 70% by weight), 0.07 parts of an acid catalyst (including solid components in an amount of 40% by weight), 61.9 parts of a silicone resin solution (SR2410 from Dow Corning Toray Co., Ltd., including solid components in an amount of 20% by weight), 0.1 parts of an aminosilane (SH6020 from Dow Corning Toray Co., Ltd., including solid components in an amount of 100% by weight), 22.1 parts of the particulate tin oxide 3, and 267 parts of toluene. Thus, a carrier 11 and a developer 11 are prepared.

Example 12

The procedure in Example 9 is repeated except that a supplemental developer including the carrier 9 in an amount of 1 part by weight and the toner 1 in an amount of 50 parts by weight is supplied to the printer during the evaluations to be described later.

Example 13

The procedure in Example 9 is repeated except that a supplemental developer including the carrier 9 in an amount of 1 part by weight and the toner 1 in an amount of 15 parts by weight is supplied to the printer during the evaluations to be described later.

Example 14

The procedure in Example 9 is repeated except that a supplemental developer including the carrier 9 in an amount of 1 part by weight and the toner 1 in an amount of 5 parts by weight is supplied to the printer during the evaluations to be described later.

Example 15

The procedure in Example 9 is repeated except that a supplemental developer including the carrier 9 in an amount of 1 part by weight and the toner 1 in an amount of 2 parts by weight is supplied to the printer during the evaluations to be described later.

Comparative Example 1

The procedure in Example 1 is repeated except for replacing the particulate tin oxide 1 with the particulate tin oxide 4. Thus, a carrier 12 and a developer 12 are prepared.

Comparative Example 2

The procedure in Example 1 is repeated except for replacing the particulate tin oxide 1 with the particulate tin oxide 5. Thus, a carrier 13 and a developer 13 are prepared.

Measurement and Evaluations

The above prepared carriers and developers are subjected to the following measurements and evaluations.

(1) Standard Deviation (σ) of Cover Area Ratio of Tin

With regard to carriers, the standard deviation (σ) of the cover area ratio of tin can be measured by EDX mapping of Sn under the following conditions. A ratio of a covering area of Sn to a surface area of one particle of a carrier is determined by image analysis. More than 10 carrier particles are subjected to this measurement procedure.

Method of fixation of specimen: carbon tape (8 mm×20 m, from Nisshin EM Corporation)

Vapor deposition: No

Accelerating voltage: 10 kV

WD: 13 mm

Aperture diameter: 30 μm

Drift correlation: No

Use of High current: No

Time constant: 20 to 30

Magnification of EDX measurement: 1000 times, 3000 times

Cumulated number: 100

Mapping (count/quantitative determination/simplified quantitative determination): count mapping Characteristic X-ray used for mapping (L-line/K-line): L-line (2) Volume Resistivity FIG. 1 is a schematic view illustrating an equipment for measuring volume resistivity of carriers. A cell 31 is a container made of a fluorocarbon resin and contains electrodes 32*a* and 32*b*. The electrodes 32*a* and 32*b* each have a surface area of 2.5 cm×4 cm and the distance between the electrodes 32*a* and 32*b* is 0.2 cm. The cell 31 is charged with a carrier (i.e., an initial carrier) 33, and tapped from a height of 1 cm for 10 times at a speed of 30 times/min. Thirty seconds after a direct current voltage of 1,000 V is applied between the electrodes, a resistance value (r) is measured using a HIGH RESISTANCE METER 4329A (from Hewlett-Packard Japan, Ltd.). The volume resistivity (R) is calculated from the following equation:

$$R=\text{Log}\,[r\times(2.5\ (\text{cm})\times 4\ (\text{cm}))/0.2\ (\text{cm})](\text{Log}(\Omega\cdot\text{cm}))$$

(3) Carrier Deposition

A developer is set in a digital full-color printer IPSIO CX8200 (from Ricoh Co., Ltd.) which is modified. The background potential is fixed to 150 V. After developing a non-image chart, the photoreceptor is visually observed using a loupe to count the number of carrier particles adhered thereto. This observation is performed 5 times by changing positions. The counted values are averaged and the averaged value is converted into the number of carrier particles adhered to an area of 100 $cm^2$. The results are graded as follows.

A: 5 or less (acceptable)

B: 6 to 20 (acceptable)

C: 21 to 60 (acceptable)

D: 61 to 80 (acceptable)

E: 81 or more (not acceptable)

The above evaluation is also performed after 100,000 sheets of a monochrome image are continuously produced to evaluate durability.

(4) Edge Effect

A developer is set in a digital full-color printer IPSIO CX8200 (from Ricoh Co., Ltd.) which is modified, and a test pattern including a large-area image is produced. The degree of edge effect is evaluated by the difference in image density between the center part and the edge part of the image as follows.

A: There is no difference.

B: There is a slight difference.

C: There is a difference. Allowable.

D: There is a significant difference. Not allowable.

(5) Image Definition

A developer is set in a digital full-color printer IPSIO CX8200 (from Ricoh Co., Ltd.) which is modified, and a text chart in which 5% of the area is occupied by characters (the size of one character is about 2 mm×2 mm) is produced. Image definition is evaluated by reproducibility of text images as follows.

A: Very good

B: Good

C: Allowable

D: Not allowable (6) Toner Scattering and Color Mixing

A developer is set in a digital full-color printer IPSIO CX8200 (from Ricoh Co., Ltd.) which is modified, and an image is produced. The degrees of toner scattering and color mixing are visually observed and evaluated as follows.

A: Good

B: Average

C: Poor (7) Durability

A developer is set in a digital full-color printer IPSIO CX8200 (from Ricoh Co., Ltd.) which is modified. A running test in which 100,000 sheets of a monochrome image is continuously produced is performed. After the running test, the amounts of decrease in charge and resistance of the carrier are measured.

The amount of decrease in charge is defined by the equation: Q1−Q2. Q1 is the charge amount of a sample in which 7% by weight of a toner are mixed with 93% by weight of an initial (fresh) carrier to be triboelectrically-charged, measured by a typical blow-off method using a blow-off device TB-200 from Toshiba Chemical Corporation. Q2 is the charge amount of a sample in which 7% by weight of a toner are mixed with 93% by weight of the deteriorated carrier which is collected from the developer after the running test, measured in the same way as Q1. The carrier is collected from the developer by removing the toner in the developer using the blow-off method. When the amount of decrease in charge is 10.0 μC/g or less, it is allowable. A reason for deterioration of charge is considered to be adherence of toner to carrier. Therefore, if the amount of toner that adheres to carrier is reduced, the amount of decrease in charge may also be reduced.

The amount of decrease in resistance is defined by the equation: R1−R2. R1 is the volume resistivity of an initial (fresh) carrier. The volume resistivity is converted from the resistance that is measured using parallel electrodes (with a gap of 2 mm) as follows. The gap between the electrodes is filled with an initial carrier and the resistance is measured by a high resistance meter 30 seconds after a direct current voltage of 1,000 V is applied to the electrodes. R2 is the volume resistivity of the deteriorated carrier which is collected from the developer after the running test, measured in the same way as R1. The carrier is collected from the developer by removing the toner in the developer using the blow-off method. When the amount of decrease in resistance is 3.0 [Log(Ω·cm)] or less, it is allowable. A reason for deterioration of resistance is considered to be abrasion of the resin coating layer, adherence of toner to carrier, and release of large particles from the resin coating layer. Therefore, if these are prevented, the amount of decrease in resistance may also be reduced.

The results of the measurements and evaluations are shown in Tables 1 to 3.

TABLE 1

| | Particulate Tin Oxide No. | Primary Particle Diameter (nm) | σ of Cover Area Ratio | Layer Thickness (μm) | Toner Supplying Method |
|---|---|---|---|---|---|
| Example 1 | 1 | 500 | 20 | 1 | Without carrier |
| Example 2 | 1 | 500 | 10 | 1 | Without carrier |
| Example 3 | 1 | 500 | 5 | 1 | Without carrier |
| Example 4 | 2 | 200 | 20 | 1 | Without carrier |
| Example 5 | 2 | 200 | 10 | 1 | Without carrier |
| Example 6 | 2 | 200 | 5 | 1 | Without carrier |
| Example 7 | 3 | 50 | 20 | 1 | Without carrier |
| Example 8 | 3 | 50 | 10 | 1 | Without carrier |
| Example 9 | 3 | 50 | 5 | 1 | Without carrier |
| Example 10 | 3 | 50 | 5 | 0.5 | Without carrier |
| Example 11 | 3 | 50 | 5 | 0.1 | Without carrier |
| Example 12 | 3 | 50 | 5 | 1 | Toner (50 parts) + Carrier (1 part) |
| Example 13 | 3 | 50 | 5 | 1 | Toner (15 parts) + Carrier (1 part) |
| Example 14 | 3 | 50 | 5 | 1 | Toner (5 parts) + Carrier (1 part) |
| Example 15 | 3 | 50 | 5 | 1 | Toner (2 parts) + Carrier (1 part) |
| Comparative Example 1 | 4 | 50 | 20 | 1 | Without carrier |
| Comparative Example 2 | 5 | 50 | 20 | 1 | Without carrier |

TABLE 2

| | Carrier Deposition (Initial) | Edge Effect | Image Definition | Toner Scattering | Color Mixing |
|---|---|---|---|---|---|
| Example 1 | C | B | B | B | A |
| Example 2 | C | C | C | B | A |
| Example 3 | B | C | C | A | A |
| Example 4 | C | B | B | B | A |
| Example 5 | B | C | C | B | A |
| Example 6 | B | C | C | A | A |
| Example 7 | B | B | B | B | A |
| Example 8 | B | C | C | A | A |
| Example 9 | B | C | C | A | A |
| Example 10 | C | B | B | A | A |
| Example 11 | C | B | B | A | A |
| Example 12 | B | C | C | A | A |
| Example 13 | A | C | C | A | A |
| Example 14 | A | C | C | A | A |
| Example 15 | B | C | C | A | A |
| Comparative Example 1 | B | D | D | B | A |
| Comparative Example 2 | B | D | D | B | C |

TABLE 3

| | Durability | | |
|---|---|---|---|
| | Carrier Deposition (after 100,000 sheets) | R1-R2 | Q1-Q2 |
| Example 1 | D | 1 | 6 |
| Example 2 | D | 0.8 | 3.5 |
| Example 3 | C | 0.7 | 3.8 |
| Example 4 | C | 0.5 | 6 |
| Example 5 | C | 0.5 | 5 |
| Example 6 | C | 0.8 | 2 |
| Example 7 | C | 0.4 | 4 |
| Example 8 | C | 0.8 | 3 |
| Example 9 | B | 0.8 | 2 |
| Example 10 | D | 1.2 | 2 |
| Example 11 | D | 1.5 | 2 |
| Example 12 | B | 0.7 | 1.5 |
| Example 13 | A | 0.5 | 1 |
| Example 14 | A | 0.3 | 0.8 |
| Example 15 | B | 0.3 | 0.5 |
| Comparative Example 1 | B | 1 | 5 |
| Comparative Example 2 | B | 1 | 6.5 |

It is apparent from the above results that the carriers of Examples 1 to 15 suppress the occurrence of carrier deposition because the resistance is controllable over a wide range. In addition, the carriers of Examples 1 to 15 produce high definition images with a low degree of edge effect and a high degree of thin-line reproducibility without causing the color contamination problem. Moreover, since the charge amount and resistance of the carriers of Examples 1 to 15 are stable, toner scattering and image density unevenness are suppressed. The carriers of Examples 1 to 15 do not damage human and environment because of including no antimony.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2008-237481, filed on Sep. 17, 2008, the entire contents of which are herein incorporated by reference.

What is claimed is:

1. A carrier for developing an electrostatic latent image, comprising:

a core material; and a resin coating layer located overlying the core material;

wherein the resin coating layer comprises a resin and a particulate tin oxide, and wherein a surface of the particulate tin oxide is coated with carbon.

2. The carrier of claim 1, wherein neither antimony nor indium is detected from the particulate tin oxide by a thermal analysis.

3. The carrier of claim 1, wherein the particulate tin oxide has a primary particle diameter of from 1 to 500 nm.

4. The carrier of claim 3, wherein the particulate tin oxide has a primary particle diameter of from 1 to 200 nm.

5. The carrier of claim 4, wherein the particulate tin oxide has a primary particle diameter of from 1 to 50 nm.

6. The carrier of claim 1, wherein a standard deviation ($\sigma$) of a cover area ratio of tin is 20 or less.

7. The carrier of claim 6, wherein a standard deviation ($\sigma$) of a cover area ratio of tin is 10 or less.

8. The carrier of claim 7, wherein a standard deviation ($\sigma$) of a cover area ratio of tin is 5 or less.

9. The carrier of claim 1, wherein the carrier has a volume resistivity of from $1\times10^{9}$ to $1\times10^{17}$ $\Omega\cdot$cm.

10. The carrier of claim 1, wherein an average thickness of the resin coating layer is from 0.05 to 2.00 μm.

11. The carrier of claim 1, wherein the carrier has a weight average particle diameter of from 20 to 65 μm.

12. The carrier of claim 1, wherein the resin includes at least one of a silicone resin and an acrylic resin.

13. The carrier of claim 1, wherein the carrier has a magnetization of from 40 to 90 $Am^2/kg$ in a magnetic field of 1 kOe.

14. A two-component developer, comprising:

a toner comprising a binder resin and a colorant; and the carrier of claim 1.

15. The two-component developer of claim 14, wherein the toner has a color other than black.

16. A supplemental developer, comprising:

the carrier of claim 1 in an amount of 1 part by weight; and a toner in an amount of from 2 to 50 parts by weight.

17. A process cartridge detachably attachable to an image forming apparatus, comprising:

at least one of an image bearing member, a charger, and a cleaning device; and a developing device containing the two-component developer of claim 14.

18. An image forming method, comprising:

forming an electrostatic latent image on an image bearing member;

developing the electrostatic latent image with the two-component developer of claim 14 to form a toner image;

transferring the toner image onto a recording medium; and fixing the toner image on the recording medium.

* * * * *